US005732857A

United States Patent [19]

Yared

[11] Patent Number: 5,732,857

[45] Date of Patent: Mar. 31, 1998

[54] METHOD AND APPARATUS FOR INSTALLING A BOTTLE ON A LIQUID DISPENSER

[76] Inventor: Linda S. Yared, 2055 Newell Ave., New Hampton, Iowa 50659

[21] Appl. No.: 512,720

[22] Filed: Aug. 8, 1995

[51] Int. Cl.[6] ..... B67D 5/06

[52] U.S. Cl. ..... 222/185.1; 141/319; 141/364; 414/758; 414/770; 414/778; 414/783

[58] Field of Search ..... 222/179.5, 185.1, 222/608, 610, 325, 146.1, 545; 141/319, 320, 364–366, 375; 417/758, 770, 778, 773, 782, 783, 785

[56] References Cited

U.S. PATENT DOCUMENTS

| | | | |
|---|---|---|---|
| 1,228,836 | 6/1917 | Schulse | 222/185.1 |
| 2,453,080 | 11/1948 | Shimp | 141/375 |
| 4,036,382 | 7/1977 | Perry et al. | 414/785 |
| 4,702,290 | 10/1987 | Perez | 141/364 |
| 4,934,420 | 6/1990 | Radna | 141/364 |
| 4,972,976 | 11/1990 | Romero | 222/185.1 |
| 5,288,200 | 2/1994 | Burgers et al. | 414/758 |
| 5,406,996 | 4/1995 | Wagner et al. | 141/364 |
| 5,513,777 | 5/1996 | Yoda et al. | 141/364 |

*Primary Examiner*—Philippe Derakshani
*Attorney, Agent, or Firm*—Wood, Phillips, VanSanten, Clark & Mortimer

[57] ABSTRACT

A liquid dispenser having a housing defining a reservoir for a supply of liquid. The housing has an upwardly facing support surface. A bottle has a wall defining a receptacle for supply of liquid and a mouth through which liquid can be introduced to the receptacle and discharged from the receptacle. First structure cooperates between the bottle and the housing for removably maintaining the bottle in an operative state wherein liquid in the receptacle communicates under the force of gravity through the bottle mouth to the reservoir. Second structure is provided on at least one of the bottle and first structure for selectively blocking flow of liquid from the bottle receptacle through the bottle mouth to the liquid dispenser reservoir with the bottle in the operative state.

12 Claims, 4 Drawing Sheets

METHOD AND APPARATUS FOR INSTALLING A BOTTLE ON A LIQUID DISPENSER

BACKGROUND OF THE INVENTION

1. Field of the Invention

This invention relates to liquid dispensers of the type using an inverted supply bottle and, more particularly, to a method and apparatus for facilitating the placement of a full bottle into its inverted, operative position.

2. Background Art

Water dispensers/coolers have been used in homes and offices for decades. The basic water cooler construction has changed little over that time. In a typical unit, an upright housing defines a reservoir that opens upwardly, with there being a cooling system that lowers the temperature of the liquid in the reservoir. A conduit communicates cooled water from the reservoir to an external spout having a valve thereon.

The housing is constructed to accept a standard, cylindrical water bottle, made of either plastic or glass. These water bottles typically have approximately a five gallon capacity.

To set up the system, the user situates the bottle in an upright position and introduces water thereto through a mouth in a necked down end. The user is then required to bring the filled bottle into the vicinity of the housing and in a relatively quick motion invert the bottle and stick the necked down portion into the reservoir. In the operative position, the bottle is supported on an annular rim, defined by the housing around the reservoir. As the bottle is inverted, water discharges until the bottle assumes its operative position. Since the bottle is not vented, the water does not pour freely therefrom. However, the water nonetheless discharges at a high enough rate that detrimental mounts of the water may be spilled on the housing or therearound, as on flooring and objects in the vicinity of the housing.

More significantly, the user is prone to injury in carrying out the quick inverting motion with the full bottle. Even with bottles made from plastic, the weight of the water alone is sufficient to highly stress the back of the user.

Whereas, at one point the use of water coolers was a mere convenience to afford more refreshing water at a temperature lower than it would come out of a tap, of late water coolers have been purchased with health considerations in mind. Contamination of wells and other water supplies has been common. This has caused the bottled water industry to flourish. Bottled spring and purified water is widely available. This bottled water is now often dispensed in homes in an uncooled state, as for cooking.

In spite of the now high volume purchase and consumption of bottled water, the user of water dispensers/coolers is required to contend with the existing, relatively primitive and inconvenient system for installing and changing bottles, described above, at the risk of injury.

SUMMARY OF THE INVENTION

In one form of the invention, a liquid dispenser is provided having a housing defining a reservoir for a supply of liquid. The housing has an upwardly facing support surface. A bottle has a wall defining a receptacle for supply of liquid and a mouth through which liquid can be introduced to the receptacle and discharged from the receptacle. First structure cooperates between the bottle and the housing for removably maintaining the bottle in an operative state wherein the liquid in the receptacle communicates under the force of gravity through the bottle mouth to the reservoir. Second structure is provided on at least one of the bottle and first structure for selectively blocking flow of liquid from the bottle receptacle through the bottle mouth to the liquid dispenser reservoir with the bottle in the operative state.

In one form, the second structure includes an adapter, third structure for operatively connecting the adapter to the bottle, and a valve on the adapter that is movable between a) an open state wherein liquid in the bottle receptacle can flow through the bottle mouth to the reservoir in the liquid dispenser with the bottle in the operative state and the adapter operatively connected to the bottle and b) a closed state wherein the valve blocks flow of liquid from the bottle receptacle through the bottle mouth to the liquid dispenser reservoir.

The third structure may removably connect the adapter to the bottle.

The adapter may have a projecting neck that extends into the reservoir with the bottle in the operative state and the adapter operatively connected to the bottle. Liquid in the receptacle can flow through the neck to the reservoir with the valve in the open state.

The bottle may have a projecting neck with a free end on which the bottle mouth is defined, with the projecting neck on the bottle having substantially the same configuration as the projecting neck on the adapter.

In one form, the upwardly facing surface on the housing defines an annular seat, and the adapter bears against the annular seat with the bottle in the operative state and the adapter operatively connected to the bottle.

The bottle may have a shoulder that faces downwardly with the bottle in the operative state and the adapter operatively connected to the bottle, with the adapter having an upwardly facing surface that bears on the bottle shoulder to define an annular contact area between the bottle and the adapter with the adapter operatively connected to the bottle.

In one form, fourth structure is provided cooperating between the liquid dispenser and at least one of the bottle and adapter with the adapter operatively connected to the bottle for guiding movement of the bottle from a first state, wherein the bottle is in an upright orientation that is inverted from an orientation the bottle has in the operative state, toward the orientation the bottle has in the operative state.

In the first state, the bottle resides at least partially beneath the upwardly facing support surface on the housing. In the first state, the bottle may not be in vertical coincidence with the liquid dispenser housing.

The fourth structure may guide pivoting movement of the bottle from the first state and toward the operative state.

The fourth structure may include a frame for receiving the bottle and fifth structure for removably connecting the frame to the liquid dispenser housing in an operative state wherein the frame is movable relative to the liquid dispenser housing to guide movement of the bottle from the first state towards the orientation the bottle has in its operative state.

At least one wheel may be provided on the frame to facilitate transportation of the frame with the bottle received thereon towards and away from the liquid dispenser housing.

The bottle receptacle may have a capacity of 2–5 gallons.

The liquid dispenser may include structure for at least one of cooling and heating liquid in the reservoir.

Structure may be provided to operate on the fourth structure to cause movement of the bottle from its first state towards the orientation the bottle has in its operative state.

The invention further contemplates the combination of a bottle and adapter, with the bottle having a wall defining a receptacle for supply of liquid, a neck, and a mouth to which liquid can be introduced to the receptacle and discharged from the receptacle. The adapter has an inlet end and a discharge end. Structure cooperates between the bottle and adapter for operatively connecting the adapter to the bottle. A valve is provided on the adapter and is movable between a) an open state wherein liquid in the bottle receptacle can flow through the bottle mouth and adapter inlet to and through the adapter outlet and b) a closed state wherein the valve blocks flow of liquid from the bottle receptacle through the bottle mouth to and through the adapter outlet. The adapter further has structure to cooperate with a liquid dispenser to support the adapter so that the bottle with the adapter connected to the bottle resides in an operative state wherein liquid in the bottle receptacle can communicate under the force of gravity through the bottle mouth to the valve inlet and to and through the valve outlet.

An actuator can be provided externally of the bottle and adapter for changing the valve between its open and closed states.

The invention further contemplates the combination of a liquid dispenser, bottle, and frame, with the liquid dispenser having a housing defining a reservoir for a supply of liquid. The housing defines an upwardly facing support surface. The bottle has a wall defining a receptacle for a supply of liquid and a mouth through which liquid can be introduced to the receptacle and discharged from the receptacle. The bottle has an upright orientation in which the mouth is at the top of the bottle and an inverted orientation in which liquid in the receptacle can flow by gravity through the bottle mouth. The frame is constructed to receive the bottle. Structure cooperates between the liquid dispenser and the frame for guiding movement of the frame between a first position wherein the bottle received by the frame is in the upright orientation and a second position wherein the bottle received by the frame is in the inverted orientation and at least partially in vertical coincidence with the liquid dispenser.

The invention further contemplates a method of placing a bottle in an operative state on a liquid dispenser including the steps of providing a bottle having a wall defining a receptacle for a supply of liquid and a mouth through which liquid can be introduced to the receptacle and discharged from the receptacle, providing a liquid dispenser having a housing defining a reservoir for a supply of liquid, providing a frame for receiving the bottle, placing the bottle on the frame with the bottle in an upright orientation such that the mouth is at the top of the bottle, guidingly moving the frame with the bottle received thereby relative to the liquid dispenser to thereby reposition the bottle to an orientation wherein the bottle is inverted with the mouth situated over the liquid dispenser reservoir so that liquid in the bottle receptacle can flow under the force of gravity from the receptacle through the bottle mouth into the reservoir, and placing the bottle in an operative state wherein the inverted bottle is supported on the liquid dispenser.

The method may further include the steps of providing a valve that can be selectively opened and closed, placing the valve on the bottle, closing the valve with the bottle in the upright orientation to prevent discharge of liquid in the bottle receptacle through the bottle mouth as the bottle is moved through the frame to the inverted orientation, placing the bottle in the operative state, and opening the valve to allow liquid in the bottle receptacle to flow under the force of gravity through the bottle mouth and into the liquid dispenser reservoir.

The method may further include the step of placing the bottle on the frame, transporting the frame with the bottle on the frame from a location spaced from the liquid dispenser to the liquid dispenser, and attaching the frame to the liquid dispenser so that the frame can be guidingly moved relative to the liquid dispenser.

DETAILED DESCRIPTION OF THE DRAWINGS

Figure 1:
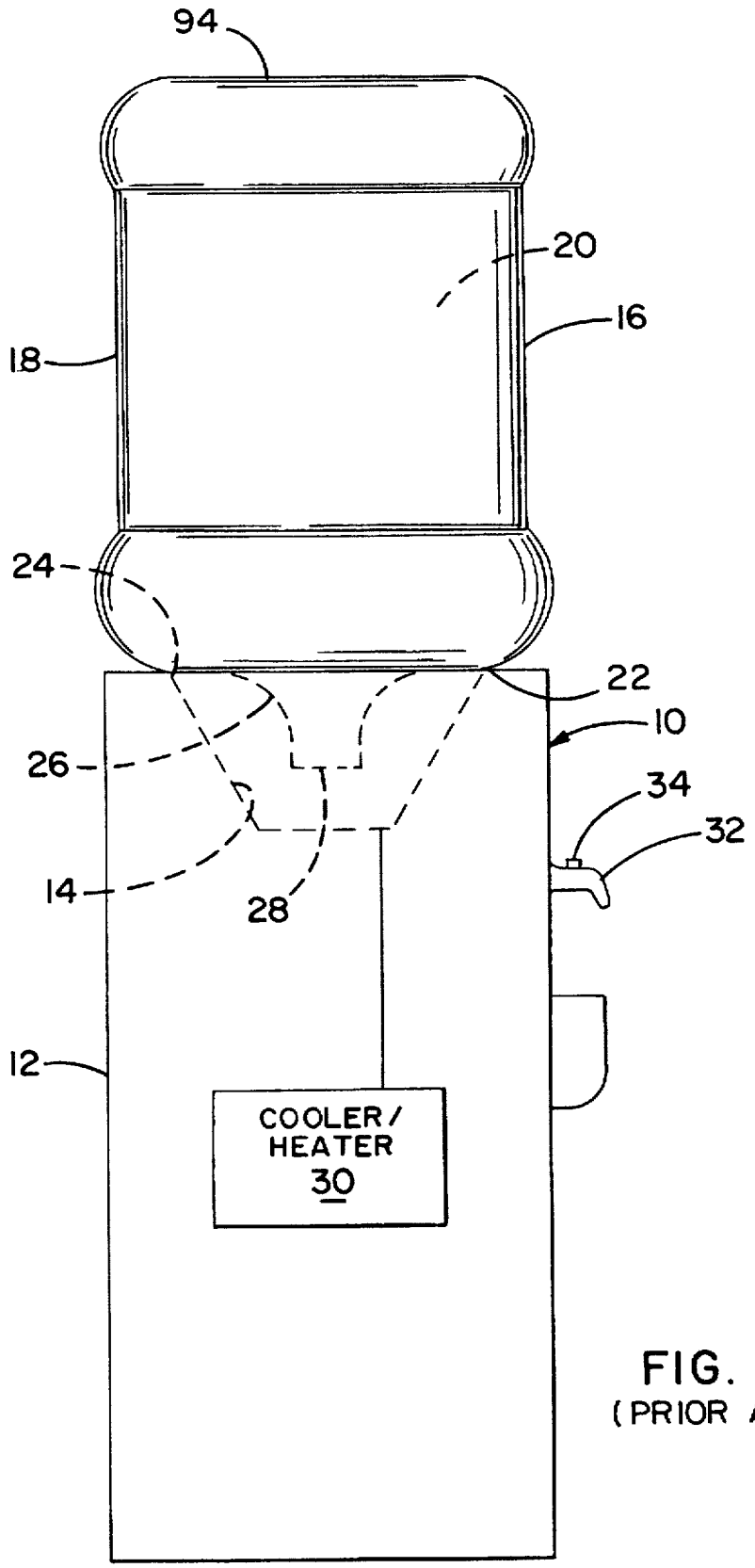
FIG. 1 (PRIOR ART)
FIG. 1 is a side elevation view of a prior art water dispenser.

In FIG. 1, a conventional liquid dispenser is shown at 10. The liquid dispenser 10 includes a housing 12 defining an upwardly opening reservoir 14 into which liquid from a supply bottle 16 flows. The bottle 16 has a wall 18 defining a receptacle 20 for a supply of liquid. Typically, the bottle 16 will have a capacity on the order of 5 gallons. The bottle 16 has an annular shoulder 22 which is supported on an upwardly facing annular surface 24, defined by the housing 12, with the bottle 16 in an operative state on the housing 12. The bottle shoulder 22 tapers down to a neck 26, which terminates at a mouth 28 through which liquid can be directed into the bottle receptacle 20 and discharged therefrom.

Within the housing 12, a cooler/heater 30 is provided to either raise or lower the temperature of liquid within the reservoir 14. Once the liquid is cooled or heated, it can be dispensed through an external spout 32 that is closed by a valve that is operable by a repressible actuator button 34.

To set up the system in FIG. 1, the bottle 16 is placed in an upright position, wherein the mouth 28 is at the top thereof. Liquid is introduced to the receptacle 20 through the mouth 28 to effect filling. Alternatively, the bottle 16 can be purchased in a pre-filled condition, with there being a sealing cap normally provided on the neck 26 over the mouth 28.

In the case of the pre-filled bottle 16, the cover (not shown) is removed from the neck 26 with the bottle 16 in the upright orientation. The user is then required to transport the bottle 16 to the housing 12 whereupon the bottle 16 is rapidly inverted and the neck 26 directed downwardly into the reservoir 14. With the bottle 16 in its operative state, the bottle shoulder 22 rests upon the housing surface 24.

In most cases, liquid will discharge through the mouth 28 as the bottle 16 is repositioned from the upright orientation to the inverted orientation of FIG. 1. As a result, a substantial amount of liquid from the bottle 16 may be lost, potentially soiling surrounding floor coverings and objects in the vicinity of the housing 12. Further, the discharging liquid may wash foreign matter on the top of the housing 12 into the reservoir 14 to potentially contaminate the liquid therein.

More significantly, the repositioning of the full bottle 16 is inconvenient and may cause injury to the installer. The installer is required to hold the full bottle 16 in front of him/her, effect inversion thereof in a jerking motion, and rapidly seat the inverted bottle to minimize liquid discharge. Given the weight of the full bottle 16, a substantial strain is placed on the installer's body, and particularly in the back region.

The inventive structure, as shown in FIGS. 2–9, obviates the above problems. The inventive structure consists of a frame 36 and adapter 38 that can be used in conjunction with a conventional bottle 16 and a conventional liquid dispenser 10 to facilitate placement of the bottle 16 in its operative state with a minimum of spillage and a minimum of inconvenience to, and strain on, the installer.

The discussion herein will initially focus on the adapter 38. The adapter 38 has an annular body 40 defining a downwardly facing surface 42 that can be placed sealingly against the upwardly facing housing surface 24. The wall 44 on the body 40 defining the surface 42 blends into a reduced diameter neck 46, terminating at a mouth 48. The neck 46 preferably has substantially the same configuration as the neck 26 on the bottle 16 so that the neck 46 will situate in the reservoir 14 in the same manner as the bottle neck 26 would in the absence of the adapter 38.

A seating element 50 surrounds the adapter neck 46, conforms to the downwardly facing adapter surface 42, and maintains the neck 46 centered within the reservoir 14.

Figure 2:
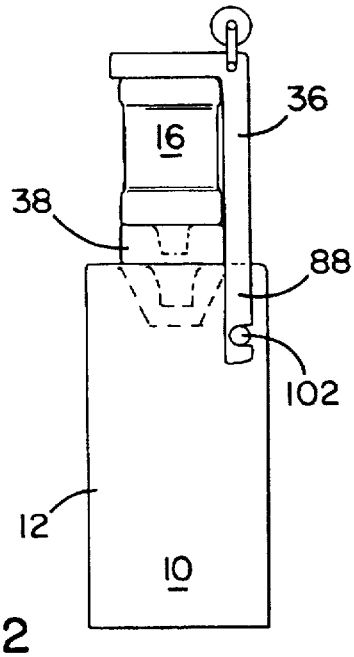
FIG. 2 is a side elevation view of a water dispenser with a bottle in an operative state thereon and a flame and adapter, according to the present invention, connected between the bottle and a housing on the water dispenser.
Figure 6:
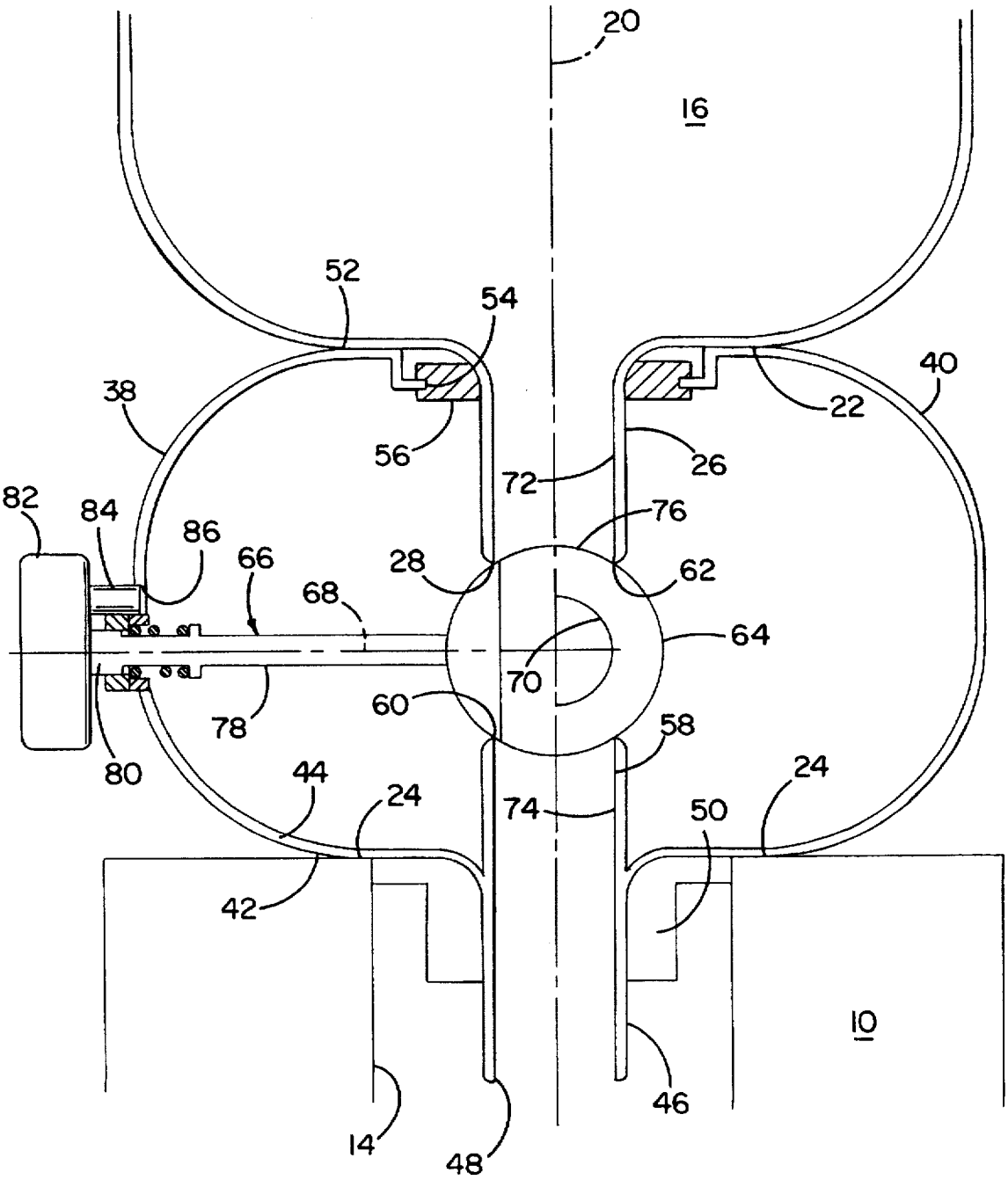
FIG. 6 is an enlarged, partial cross-sectional view of the water dispenser with an adapter, according to the present invention, attached to the bottle, the bottle in the operative state of FIG. 2, and a valve on the adapter shown in a closed state.

An upwardly facing surface 52 is provided at the top of the adapter 38 and bears against the bottle shoulder 22 with the bottle 16 in the operative state of FIGS. 2 and 6. The adapter 38 has a top inlet opening 54 to receive the bottle neck 26. A gasket 56 extends around the opening 54 and sealingly grips the bottle neck 26 to establish a leakproof connection between the adapter 38 and bottle 16.

The adapter neck 46 has an upward extension 58 with an upper edge 60. The edge 60 and an edge 62 at the distal end of the bottle neck 26 cooperatively define a seat for a ball element 64 on a valve 66 on the adapter 38. The edges 60, 62 cooperatively guide pivoting movement of the ball element 64 around a horizontally extending axis 68.

The ball element 64 has a through opening 70 which can be placed in registration with the bottle neck opening 72 and adapter neck opening 74 with the valve 66 in an open state, to allow flow of liquid from the bottle receptacle 20 through the adapter inlet opening 54, the opening 70 in the ball element 64 and through the outlet opening 48/mouth on the adapter neck 46.

By pivoting the valve ball element 64, with the valve 66 in the open state, the valve 66 can be placed in a closed state, as shown in FIG. 6, wherein the peripheral surface 76 seals against the bottle neck edge 62 and the adapter edge 60 to block flow of liquid in the bottle receptacle 20 to the reservoir 14.

Change between the open and closed states for the valve 66 is accomplished by rotating the ball element 64 through 90° around the horizontal axis 68. This movement is effected through an elongate stem 78, which connects fixedly to the ball element 64 and projects to externally of the adapter body 40. The exposed free end 80 of the stem 78 is fit with an enlarged actuating knob 82, through which rotation of the stem 78 is facilitated.

The actuating knob 82 has a post 84 projecting in cantilever fashion therefrom into a guide slot 86 on the adapter body 40. The post 84 abuts the extremities of the slot 86 with the valve 66 in each of the open and closed positions. The body 40 can be marked in the vicinity of the slot 86 to give the user a clear indication of the state of the valve 66.

According to the invention, the adapter 38 can be removably press connected to the bottle 16 to the operative position shown in FIGS. 2–6. The adapter 38 can be removed to fill the bottle 16 and then replaced. By placing the valve 66 in the closed state, the filled bottle 16 can be inverted without permitting a discharge of liquid from the receptacle 20. A subassembly consisting of the bottle 16 and adapter 38 can then be placed in this state into the operative position on the housing 12, as shown in FIGS. 2 and 6. The valve 66 can then be opened to allow flow of liquid from the receptacle 20 through the bottle neck 26, the ball element 64, and the adapter neck 46 into the reservoir 14. Spillage of liquid from the bottle 16 as the bottle is inverted is thus avoided.

The aforementioned frame 36 further facilitates the placement of the bottle 16, with the adapter 38 thereon, into the operative state of FIGS. 2 and 6. The frame 36 has an upright frame element 88 and a support platform 90 projecting at substantially a fight angle to the length of the frame element 88. The platform 90 has an upwardly facing surface 92 for receiving and supporting the bottom 94 of the bottle 16.

Figure 3:
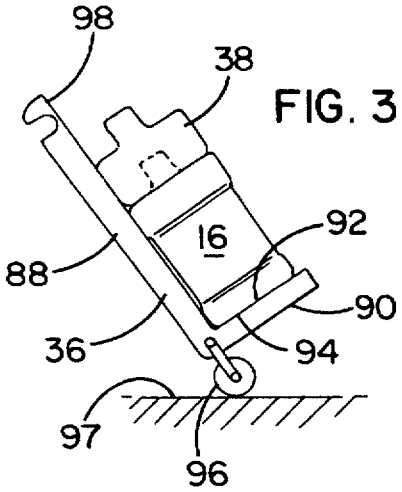
FIG. 3 is a side elevation view of the bottle with the adapter thereon situated in a carrying position on the frame and with the frame detached from the water dispenser to facilitate transportation of the bottle therethrough.

The frame 36 has a pair of wheels 96 (one shown), which support the frame 36 on a subjacent surface 97 and allow the frame 36 to be used as a dolly with the frame 36 and bottle 16 in the FIG. 3 position. The upper free end 98 of the frame element 88 is functional as a graspable handle to facilitate rolling of the frame 36 over the subjacent supporting surface 100.

According to the invention, a guide post 102 is fixed to the housing 12 and projects outwardly therefrom in cantilever fashion. The post 102 can be moved against a U-shaped seat 104 defined by the frame element 88 so that the free end 98 of the frame element 88 can be guidingly pivoted around the post 102. To place the guide post 102 against the seat 104, the frame 36 is wheeled adjacent to the housing 12 to a position shown in FIG. 4, wherein the post 102 aligns with an entry opening 106 on the frame element 88.

Figure 8:
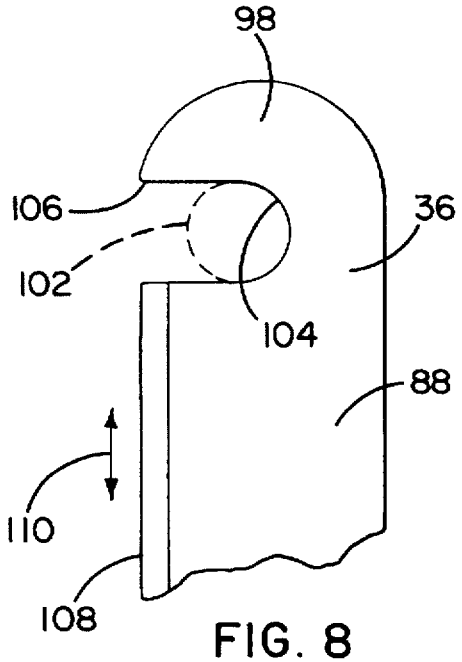
FIG. 8 is an enlarged, fragmentary, side elevation view of a connecting arm on the frame.
Figure 9:
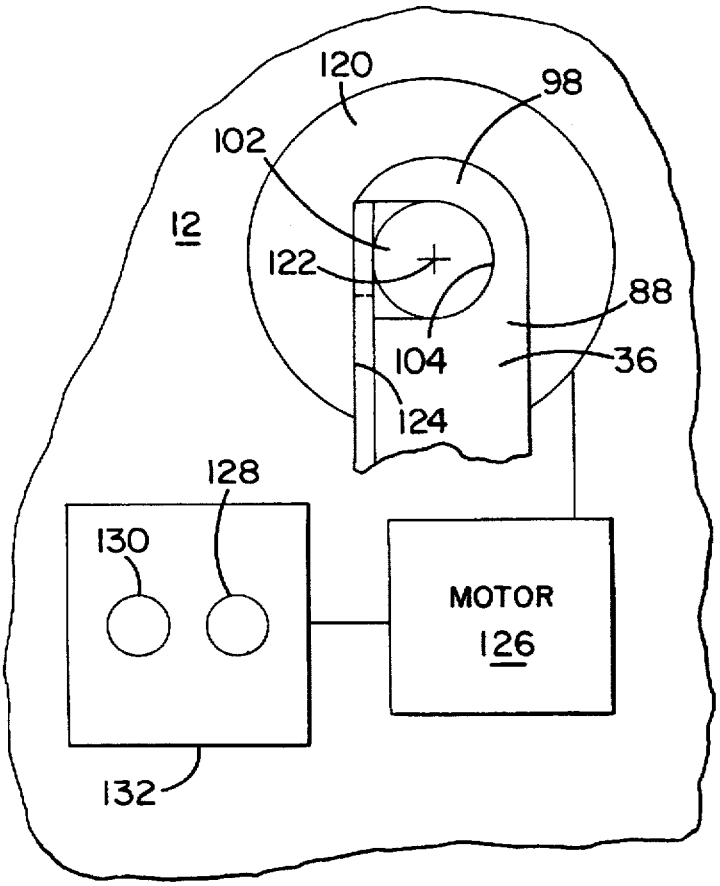
FIG. 9 is a view as in FIG. 8 with the connecting arm operatively connected to the housing and showing a system, according to the present invention, for repositioning the frame between the positions shown in FIGS. 2 and 4.

An optional locking plate 108 is slidably mounted to the frame element 88 in the line of the double-headed arrow 110 between an open position, shown in FIG. 8, wherein the entry opening 106 is fully exposed, and a closed position, as shown in FIG. 9, wherein the plate 108 extends across the entry opening 106 to thereby block the post 102 against the seat 104.

Figure 4:
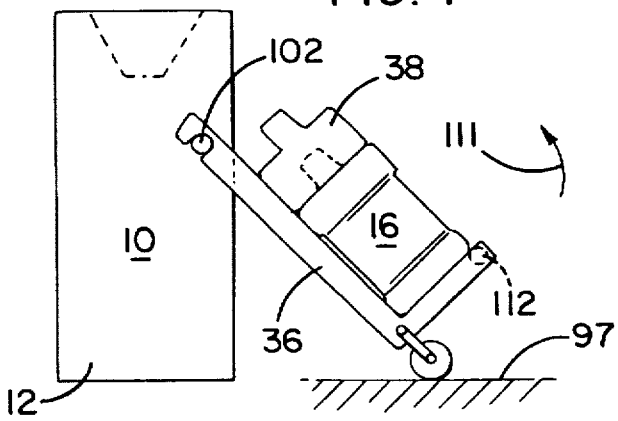
FIG. 4 is a side elevation view of the frame with the bottle thereon attached to a housing on the water dispenser so as to facilitate repositioning of the bottle to the operative state of FIG. 2.
Figure 5:
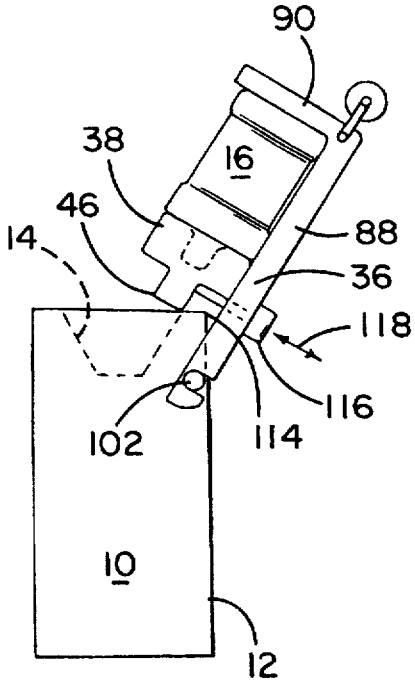
FIG. 5 is a view as in FIG. 4 with the frame, bottle and adapter pivoted from the FIG. 4 position towards the operative state of FIG. 2.

The use can then pivot the frame 36, bottle 16 and adapter 38 from the FIG. 4 position, in the direction of the arrow 111 to the FIG. 5 position, and ultimately to the FIG. 2 position, wherein the bottle 16 assumes the operative state. A hand opening 112 may be provided in the support platform 90 to facilitate gripping thereof by the user and pivoting of the frame 36. Once the neck 46 of the adapter 38 clears the upper corner 114 of the housing 12, the adapter 38 can be moved against the housing 12 to guide the adapter neck 46 into the reservoir 14.

An optional pin 116 can be mounted to the frame element 88 for movement in the line of the double-headed arrow 118 between an extended position, shown in FIG. 5, wherein the pin 116 maintains the adapter 38 and bottle 16 captive against the platform 90, and a retracted position, wherein the adapter 30 and the bottle 16 can be moved freely lengthwise of the frame element 88. The pin 116 can be used to avoid downward sliding movement of the adapter 38 and bottle 16 as the frame 36 approaches the FIG. 5 position.

Another aspect of the invention is the provision of structure to automatically reposition the frame 36 without requiring the user to bear the weight of the full bottle 16. Structure to accomplish this is shown in FIG. 9. A disk 120 is provided on the housing 12 and is rotatable relative to the housing 12 about an axis 122, coinciding with the center of the guide post 102. The disk 120 has an undercut receptacle 124 corresponding to the shape of the free end 98 of the frame element 88. The frame element 88 thus makes keyed connection with the disk 120.

Rotation is imparted to the disk 120 through a motor 126 that is operable selectively in forward and reverse directions through separate switches 128, 130 on an actuator 132. Thus, by simply actuating the motor 126, the frame 36 can be moved through the disk 120 from the FIG. 4 position to the FIG. 2 position.

Figure 7:
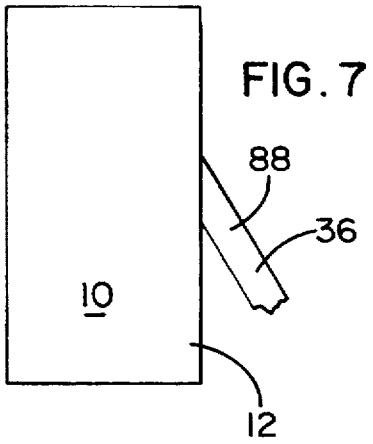
FIG. 7 is a fragmentary, side elevation view of a water dispenser with a modified form of frame, according to the invention, mounted to the housing on the water dispenser in a different location than shown for the frame in FIGS. 2, 4 and 5.

As shown in FIG. 7, the frame 36 can be formed with a single upright frame dement 88, which can be connected to a guide post (not shown) located midway between two oppositely facing walls on the housing 12. Alternatively, as shown in FIGS. 2, 4 and 5, the housing 12 can have oppositely projecting posts 102, with there being spaced frame elements 88 connecting, one each, to a post 102.

With the inventive structure, the installer can place an empty bottle 16 on the frame 36 in an upright position and effect filling of the bottle 16. The adapter 38 is then connected and the valve 66 closed. The installer then wheels the frame 36 over to the housing 12, effects connection between the frame 36 and housing 12, repositions the locking plate 108 and pin 116, and operates the motor 126 to pivot the frame 36 from the FIG. 4 position to the FIG. 5 position. The pin 116 is then withdrawn, whereupon the bottle 16 and adapter 38 can slide downwardly until the bottle 16 realizes the operative position of FIG. 2. The frame 36 can be pivoted to the FIG. 2 position as the bottle 16 slides into the operative state. By opening the valve 66, the system is made ready for use.

The user is not required to manually lift the full bottle 16. At the same time, escape of liquid from the receptacle 20 is precluded by the adapter valve 66. Even if the frame 36 is not used, the installer is aided by not having to abruptly invert the bottle 16. This lessens the likelihood of injury.

The foregoing disclosure of specific embodiments is intended to be illustrative of the broad concepts comprehended by the invention.

I claim:

1. In combination:

a liquid dispenser having a housing defining a reservoir for a supply of liquid, said housing defining an upwardly facing support surface;

a bottle having a wall defining a receptacle for a supply of liquid and a mouth through which liquid can be introduced to the receptacle and discharged from the receptacle;

first means cooperating between the bottle and the housing for removably maintaining the bottle in an operative state wherein liquid in the receptacle communicates under the force of gravity through the bottle mouth to the reservoir; and second means cooperating between the liquid dispenser and bottle for guiding movement of the bottle from a first state wherein the bottle is in an upright orientation that is inverted from an orientation the bottle has in the operative state toward the orientation the bottle has in the operative state, wherein the second means comprises a frame for receiving the bottle and third means for connecting the frame to the liquid dispenser housing in an operative state wherein the frame is movable relative to the liquid dispenser housing to guide movement of the bottle from the first state towards the orientation the bottle has in its operative state.

2. The combination according to claim 1 including at least one wheel on the frame to facilitate transportation of the frame with the bottle received thereon towards and away from the liquid dispenser housing.

3. The combination according to claim 1 wherein the bottle receptacle has a capacity of 2–5 gallons.

4. The combination according to claim 1 wherein the liquid dispenser includes means for at least one of cooling and heating liquid in the reservoir.

5. The combination according to claim 1 wherein the fourth means comprises means for removably connecting the frame to the liquid dispenser housing.

6. The combination according to claim 1 wherein there are fourth means on the first means for selectively blocking flow of liquid from the bottle receptacle through the bottle mouth.

7. The combination according to claim 6 wherein the fourth means comprises a valve that is movable between open and closed states.

8. The combination according to claim 7 wherein the valve is part of an adapter that is removably connected to the bottle.

9. The combination according to claim 8 wherein the adapter has a projecting neck that extends into the reservoir with the bottle in the operative state and the adapter operatively connected to the bottle and through which liquid in the bottle receptacle communicates to the reservoir with the valve in the open state.

10. The combination according to claim 8 wherein the bottle has a shoulder that faces downwardly with the bottle in the operative state and the adapter operatively connected to the bottle and the adapter has an upwardly facing surface that bears on the bottle shoulder to define an annular contact area between the bottle and the adapter with the adapter operatively connected to the bottle.

11. The combination according to claim 9 wherein the bottom has a projecting neck, the adapter is selectively removable from the bottle, there are means cooperating between the bottle and housing for removably maintaining the bottle with the adapter removed therefrom in the operative state wherein the neck of the bottle extends into the reservoir so that liquid can flow from the bottle through the bottle neck into the reservoir.

12. The combination according to claim 1 wherein the fourth means comprises means for removably connecting the frame to the liquid dispenser housing.

* * * * *